United States Patent [19]

Bolha

[11] 4,411,117

[45] Oct. 25, 1983

[54] BUILDING SIDING REPLACEMENT DEVICE AND METHOD

[76] Inventor: David J. Bolha, 939 S. Schenley Ave., Youngstown, Ohio 44509

[21] Appl. No.: 265,382

[22] Filed: May 20, 1981

[51] Int. Cl.[3] ..... E04C 1/34; E02D 37/00; E04D 1/00; E04G 23/02

[52] U.S. Cl. ..... 52/521; 52/459; 52/514; 52/520; 52/531; 52/743; 52/748

[58] Field of Search ..... 52/521, 518, 519, 531, 52/544, 545, 748, 551, 549, 459, 741, 514, 529, 530, 743, 520

[56] References Cited

U.S. PATENT DOCUMENTS

| | | | |
|---|---|---|---|
| 2,766,861 | 10/1956 | Abramson | 52/531 |
| 4,096,679 | 6/1978 | Naz | 52/545 |
| 4,187,661 | 2/1980 | Poiry | 52/514 |

*Primary Examiner*—Alfred C. Perham
*Assistant Examiner*—Eugene R. Washington
*Attorney, Agent, or Firm*—Harpman & Harpman

[57] ABSTRACT

A method of removing and reinstalling metal siding on buildings utilizes a novel clamping strip in repositioning and attaching a section of metal siding that has been cut longitudinally from the building to provide access for the drilling of holes for the injection therethrough of blown insulation.

6 Claims, 4 Drawing Figures

BUILDING SIDING REPLACEMENT DEVICE AND METHOD

BACKGROUND OF THE INVENTION

1. Technical Field

This invention relates to methods and devices by which metal siding can be removed from buildings preparatory to the necessary drilling of the supporting wall structures to provide access to the zones between adjacent studs for the purpose of installing blown in insulation material, and reinstalling the removed siding.

2. Description of the Prior Art

Prior methods and devices have generally comprised the removal of a longitudinal strip of metal siding and the installation of a new strip in place thereof when the insulation of the wall cavity has been completed. The removal of the original siding section usually damaged the same so that it could be replaced and the substitution of a new section of siding changed the appearance because the color, texture or faded appearance of the original siding did not match the newly installed new section.

Due to the cosmetic change in the appearance of the building, many home owners have decided not to insulate their homes.

A typical prior art metal siding is illustrated in U.S. Pat. No. 2,766,861 and those skilled in the art will observe that vinyl siding of substantially the same configuration is also widely employed.

U.S. Pat. No. 4,187,661 discloses a proposal for removing metal siding and reinstalling the same and it has been found that the use of the tool and the method of this disclosure usually results in distortion and damage of the metal siding and the inability of the reinstalled siding to remain firmly in desired position.

The present method enables a section of metal siding to be removed by simply cutting the same adjacent its uppermost edge and immediately beneath a horizontal lip portion of the siding and eventually reinstalling the removed section by first applying a longitudinally extending clamping strip having a configuration that will clampingly engage the cut edge of the metal siding strip being reinstalled.

SUMMARY OF THE INVENTION

A method of removing and reinstalling metal siding on a building is disclosed which uses a clamping strip to secure a cutaway piece of metal siding to the fastening configuration of the siding piece thereabove and immediately adjacent the horizontal portion thereof, the visual part of the strip taking the form of a narrow bead-like section which lies immediately under the horizontal portion of the siding strip above the reinstalled section and is hidden in the natural shadow line thereof.

DESCRIPTION OF THE PREFERRED EMBODIMENT

Figure 1:
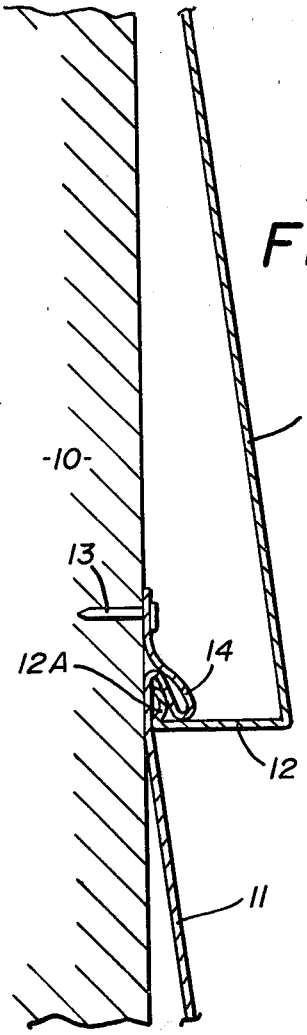
FIG. 1 is a cross sectional side elevation of a portion of a building wall and two pieces of metal siding attached thereto.
Figure 2:
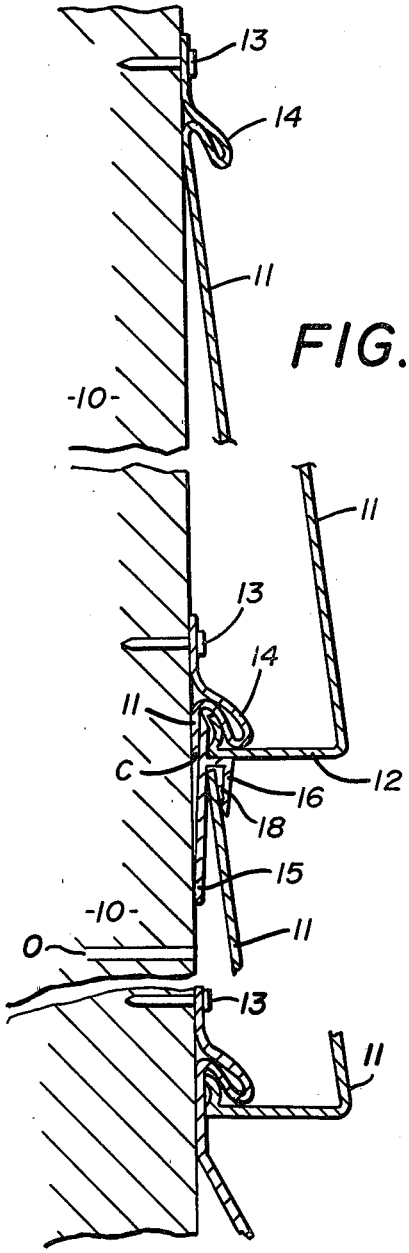
FIG. 2 is a cross sectional side elevation of a portion of a building wall showing two pieces of metal siding attached thereto, one of which has been cut longitudinally inwardly of its upper edge below its fastening configuration and reinstalled with a longitudinally extending clamping strip.

By referring to the drawings and FIGS. 1 and 2 in particular, it will be seen that a supporting wall 10 carries longitudinal sections of metal siding which comprise substantially vertical sections 11 and horizontal sections 12 with the upper longitudinal edges of the vertical sections 11 being attached to the supporting wall 10 by fasteners 13.

The horizontal sections 12 which form the lower edges of the sections of metal siding have upturned longitudinally extending, cross sectionally arcuate flanges 18 formed continuously therealong with are adapted to be engaged beneath continuously extending outwardly and downwardly folded lips 14 formed just below the upper edges of the vertical sections 11 of the metal siding. Those skilled in the art will understand that when the metal siding is installed on the supporting wall 10 the flanges 13 on the horizontal sections 12 of each successively installed section of metal siding is engaged under the folded lip 14 of the section of siding therebelow and then attached to the supporting wall by the fasteners along its uppermost edges.

The lowermost strip of metal siding is commonly attached to the wall by a longitudinally extending starting piece as seen for example in U.S. Pat. No. 2,766,861 and common in the art.

Figure 3:
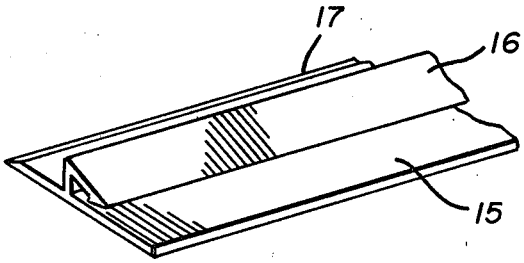
FIG. 3 is a perspective view of the clamping strip seen in FIG. 2.

By referring now to FIG. 2 of the drawings in particular, it will be seen that portions of two strips of metal siding have been illustrated, each attached to the supporting wall along its uppermost edge by the fasteners 13 and each having a folded lip 14 thereon. The lowermost one of the two sections of metal siding illustrated in FIG. 2 has been cut longitudinally thereof at a cut line indicated by the letter C, the cut line C being just below the horizontal section 12 of the upper section of metal siding. The lower section of metal siding was therefore freed from its attachment to the supporting wall 10 by the fastener 13 and the cutaway section thus capable of being removed so that an opening O could be formed in the supporting wall 10 through which insulation could be blown as desired. When this has been completed the opening is usually patched by inserting a plug or the like and the cutaway section of metal siding can then be reinstalled by the method disclosed herein and through the use of an elongated section of clamping strip 15 which has an integral outwardly and downwardly hook flange 16 formed continuously thereon and inwardly of its upper and lower edges. A perspective view of a section of the clamping strip may be seen in FIG. 3 and in FIG. 2 of the drawings the clamping strip 15 will be seen installed with the uppermost flange thereof which is tapered as at 17, pushed upwardly so as to be frictionally engaged between the remaining portion of the vertical section 11 of the lower section of metal siding and the upturned arcuate flange 13 of the horizontal section 12 of the upper section of metal siding, the arrangement is such that the outwardly and downwardly extending hook flange 16 is positioned immediately below and in contact with the horizontal section 12 of the upper section of metal siding as seen in FIG. 2 of the drawings.

Figure 4:
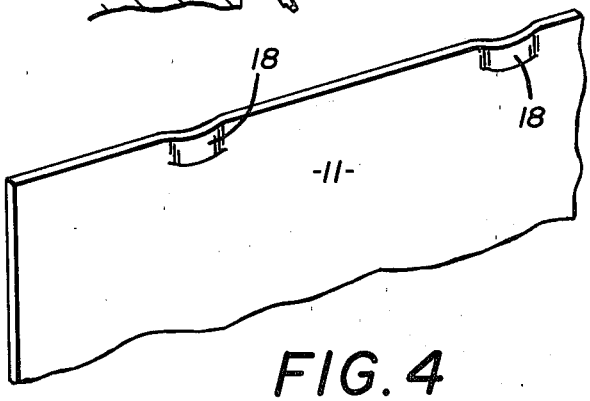
FIG. 4 is a section of the upper edge of the cut piece of metal siding showing fastening configurations stamped therein for cooperation with the clamping strip.

The lower cutaway section of metal siding 11 is then provided with a plurality of crimped or bulged fastening configurations 18 along its uppermost cut edge as best seen in FIG. 4 of the drawings and then pushed upwardly into frictional engagement with the inner surface of the outwardly and downwardly extending hook flange 16 on the clamping strip 15, while its lower edge with its horizontal section 12 and upturned arcuate flange 13 re-engages the folded lip 14 as hereinbefore described.

The reinstallation of the cutaway section of metal siding is thus completed as the fastening configurations 18 engage the hook configuration of the hook flange 16 of the clamping strip 15. The exposed portion of the hook flange 16 will thus be seen to be positioned immediately in under the horizontal section 12 of the metal siding section where it forms an inconspicuous shadow line along with the usual shadow line defined by the horizontal section 12.

The clamping strip 15 is preferably extruded of a suitable synthetic resin such as vinyl and preferably in a color matching that of the enameled finish of the metal siding with which it is used.

It will thus be seen that a novel method of removing and replacing a longitudinal section of metal siding from a supporting wall of a building has been disclosed and which utilizes the novel clamping strip disclosed herein as an essential part of the novel method. In effect the clamping strip 15 with its hook flange 16 becomes part of a combination consisting of the cutaway section of the metal siding and the clamping strip.

The combination thus formed repositions the section of the metal siding that was cut away and removed in substantially its original location and together with the lower portion of the siding section thereabove and the remainder of the cutaway section insures the desirable positioning and retention of the cutaway section on the supporting wall.

It will thus be seen that an inexpensive easily performed method of removing and reinstalling a section of metal siding has been disclosed and which method incorporates the use of a novel clamping strip which becomes part of the metal siding installation and its attachment means.

Although but one embodiment of the present invention has been illustrated and described, it will be apparent to those skilled in the art that various changes and modifications may be made therein without departing from the spirit of the invention and having thus described my invention

What I claim is:

1. A method of removing and reinstalling building siding comprising the steps of cutting a first section of siding to be removed immediately below the lower marginal edge of a second section of siding, moving the first section of siding downwardly so as to uncouple the overlapped lower edge of said first section of siding from a third section of siding, removing the first section of siding from the associated building, positioning a clamping strip having a hook shaped flange thereon partially between the remaining portion of the first section of siding and the lower marginal edge of the second section of siding, reinstalling said second section of siding by placing the free severed upper edge portion thereof between said clamping strip and the hook shaped flange thereon and re-engaging the lower edge of said first section of siding on said third section of siding.

2. The method of claim 1 and including forming sideward projections along the upper edge of said second section of siding and moving said upper edge upwardly to place the projections between the clamping strip and the hook shaped flange thereon engaging the same.

3. The method of claim 1 and including cutting the first section of siding to be removed inwardly of its upper edge and parallel thereto and longitudinally thereof.

4. The method of claim 1 and including cutting the first section of siding to be removed longitudinally thereof and below a portion thereof normally overlapping the lower marginal edge of said second section of siding.

5. The method of claim 1 and wherein said hook shaped flange on said clamping strip is disposed midway between the longitudinal edges thereof.

6. The combination of a section of siding having a downturned lip continuously on its upper edge and secured to a supporting wall at points above said downturned lip and being cut longitudinally below said downturned lip, fastening configurations formed in the upper part of said section of siding adjacent to and below said cut and a clamping strip, an outward and downward flange on said clamping strip inwardly of the edges thereof, a continuous inturned angular edge on said downturned flange, said upper part of said section of siding below said longitudinal cut and said fastening configurations being engaged between said clamping strip and the downturned flange thereon with said fastening configurations engaging said continuous inturned angular edge on said downturned flange so as to join and fasten said section of siding below said cut with said downturned lip.

* * * * *